United States Patent [19]

Dettmers et al.

[11] 4,422,807

[45] Dec. 27, 1983

[54] MINE ROOF SUPPORTS

[75] Inventors: Michael Dettmers, Kamen; Walter Weirich, Dortmund; Bernd Peters, Dülmen, all of Fed. Rep. of Germany

[73] Assignee: Gewerkschaft Eisenhutte Westfalia, Lunen, Fed. Rep. of Germany

[21] Appl. No.: 451,447

[22] Filed: Dec. 20, 1982

Related U.S. Application Data

[63] Continuation of Ser. No. 216,200, Dec. 15, 1980, abandoned.

[30] Foreign Application Priority Data

Jan. 5, 1980 [DE] Fed. Rep. of Germany ..... 3000237

[51] Int. Cl.[3] ..... E21D 15/44

[52] U.S. Cl. ..... 405/296; 405/302

[58] Field of Search ..... 405/291, 292, 295, 296, 405/302; 91/170 MP, 358 A; 248/357; 299/33

[56] References Cited

U.S. PATENT DOCUMENTS

| | | | |
|---|---|---|---|
| 3,400,634 | 9/1968 | Wirtz | 91/358 A |
| 3,478,522 | 11/1969 | Rieschel | 405/302 X |
| 3,898,845 | 8/1975 | Plevak et al. | 405/296 |
| 4,222,686 | 9/1980 | Bell et al. | 405/295 |

FOREIGN PATENT DOCUMENTS

| | | | |
|---|---|---|---|
| 2507319 | 7/1976 | Fed. Rep. of Germany | 405/296 |

*Primary Examiner*—David H. Corbin

*Attorney, Agent, or Firm*—Thompson, Birch, Gauthier & Samuels

[57] ABSTRACT

A mine roof support has hydraulic props mounted between a floor sill and a roof bar which can be raised and lowered by extension and retraction of the props. A goaf shield is pivotably connected to the rear of the roof bar and is linked via levers to the floor sill. A hydraulic piston and cylinder unit is connected between the roof bar and the goaf shield. Apparatus serves to prevent damage to the support components, and especially to the unit which could be extended beyond its full stroke when the props are retracted to bring the goaf shield and the roof bar more or less into alignment. The protective apparatus is composed of a compact valve device operated by a member, such as a cam, to block the props from hydraulic pressure when the goaf shield and the roof bar assume a pre-determined angular disposition. Both the valve device and its operating member are disposed in a protected position within chambers formed inside the roof bar and the goaf shield adjacent the pivot connection therebetween.

13 Claims, 3 Drawing Figures

MINE ROOF SUPPORTS

This application is a continuation of application Ser. No. 216,200, filed Dec. 15, 1980, now abandoned.

BACKGROUND OF THE INVENTION

The present invention relates in general to mine roof supports.

Various forms of roof supports have been proposed and adopted. One type of support, with which the present invention is concerned, employs a floor-engageable structure, such as a sill, a roof-engageable structure, such as a bar or frame, hydraulic props mounted between the floor-engageable structure and the roof-engageable structure and operable to raise and lower the latter and a goaf shield pivotably connected to the rear of the roof-engageable structure relative to a mineral face. Levers normally connect the lower part of the goaf shield to the floor-engageable structure. A piston and cylinder unit serves to control the pivotal motion between the roof-engageable structure and the goaf shield during operation of the props and stabilizes the pivot connection between the goaf shield and the roof-engageable structure. The unit is connected to the goaf shield and the roof engageable structure to extend across the pivot connection therebetween. To prevent damage to the unit, apparatus has been known which blocks the props from the pressure supply during retraction once the unit has been almost fully extended to its maximum working stroke. This known apparatus, described in U.S. Pat. No. 4,222,686 (Bev, et al.), utilizes a control rod mounted to the piston rod of the unit and extending parallel to the unit. The control rod is guided for sliding on a device fitted to the cylinder of the unit. The control rod is provided with a pair of stops spaced apart axially of the unit and these stops actuate a pilot valve mounted to the cylinder of the unit. The pilot valve in turn controls the application of pressure fluid to the props and blocks the pressure supply when the unit is approaching its fully extended position. The motion of the control rod to operate the valve is the same as the associated stroke of the unit. This known apparatus suffers from a number of disadvantages:

For example it is not particularly compact and it is prone to damage and hence is not particularly reliable.

SUMMARY OF THE INVENTION

The present invention provides protective apparatus entirely separate from the aforementioned unit and in a protected position near the pivot connection between the roof-engageable structure and the goaf shield.

In one aspect the invention provides a hydraulic valve device and means for operating said device, the valve device and the operating means being mounted to the roof-engageable structure and the goaf shield whereby the valve device is operated by the means to prevent operation of the props whenever the roof-engageable structure and the goaf shield reach a predetermined relative angular disposition.

The invention also provides chambers within the goaf shield and the roof-engageable structure, a valve device and means for operating said valve device accommodated within the chambers, the operating means serving to operate the valve device automatically to effectively block the props from the pressure fluid supply to prevent their retraction whenever the roof-engageable structure and the goaf shield assume a predetermined angular relationship.

In contrast to the known apparatus, apparatus constructed in accordance with the invention can be especially compact and protected and is operated to block the props in sole dependence on the relative angular position of the goaf shield in respect to the roof-engageable structure. The apparatus can thus be adopted, if desired, in supports without the aforementioned control piston and cylinder unit.

To enhance the protection of the valve device and its operating means one or more covers can be secured to the roof-engageable structure and/or the goaf shield.

The motion of the operating means is now non-rectilinear rectilinear and a comparatively small arcuate motion is sufficient to actuate the valve device. The operating means can take a variety of forms but in one embodiment of the invention this means is a simple plate provided with a curved, e.g. arcuate or concave, cam surface engaging with a spring-loaded plunger of the valve device. The cam surface is conveniently continuous although it could be stepped. Preferably a depression is provided in the cam surface to initiate the blocking of the props when contacted by the plunger or actuating member of the valve device. This plunger may then move into or out from a body of the valve device to open or close a valve therein in dependence on the shape of the moving cam surface. Conveniently, the cam surface has a centre of curvature which coincides with the pivot axis of the pivot connection between the goaf shield and the roof engageable structure.

The invention may be understood more readily, and various other features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
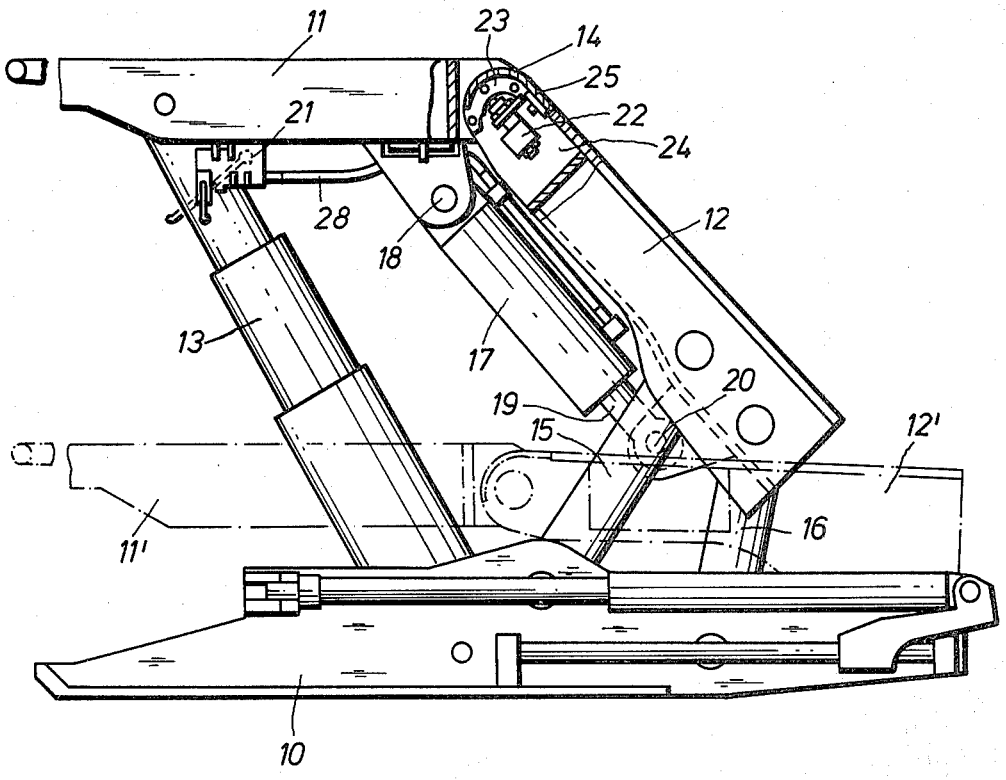
FIG. 1 is a part-sectional schematic side view of a mine roof support provided with apparatus constructed in accordance with the invention.

As shown in FIG. 1, a mine roof support is composed of a floor sill structure 10, a roof-engageable structure 11, hydraulic props 13 disposed between the roof and floor structures 10, 11 and a goaf shield 12. The roof support can be of conventional known design. The floor and roof structures 10, 11 can be of single or multi-part construction and the props 13 are preferably connected with the structures 10, 11 by way of ball-and-socket joints. Two props 13 can be provided, for example, in side-by-side relationship. Pressure fluid is fed to or from the props 13 by way of a control valve device 21 conveniently positioned at the underside of the roof stucture 11 as shown. The upper end of the goaf shield 12 is connected to the rear end of the roof structure 11 with a pivot connection 14 while the lower end of the goaf shield 12 is linked to the floor structure 10 with the aid of pivotable levers 15, 16. The pivot connection 14 can take the form of two oppositely-located pivot pins at the lateral side of the shield 12 and the roof structure 11. The levers 15, 16 combine with the goaf shield 12 to form the so-called lemniscate guide system known per se. The pivot axes of the levers 15, 16 and of the connection 14 extend parallel to one another and generally parallel to the mineral face (not shown).

A piston and cylinder unit 17 serves to stabilize the connection 14 and controls the position of the roof structure 11 in relation to the goaf shield 12, as also known per se, when the props 13 extend and retract. The unit 17 is connected via pivot joints 18, 20 to brackets on the roof structure 11 and the shield 12.

As the props 13 extend and retract the angle between the roof structure 11 and the goaf shield 12 alters and the unit 17 correspondingly extends and retracts. FIG. 1 depicts in full outline the relative position between the shield 12 and the roof structure 11 with the props 13 partially extended to some intermediate extent. The angle between the roof structure 11 and the shield 12 is about 120°–140° with the props 13 set to this illustrated intermediate position. In contrast, the relative position between the shield 12 and the roof structure 11 with the props 13 fully retracted is depicted in chain dotted lines 11', 12' in FIG. 1. In this case, the roof structure 11 is more or less in coplanar alignment with the shield 12 with the angle therebetween about 180°. As the props 13 extend further beyond their intermediate setting shown in FIG. 1, the angle between the roof structure 11 and the shield 12 approaches 90°.

Figure 3:
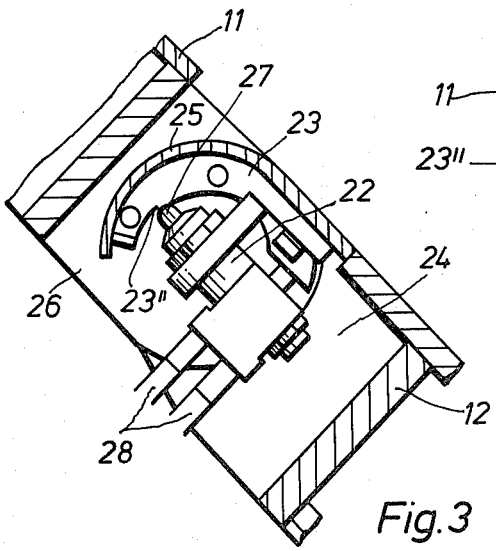
FIG. 3 is a view corresponding to FIG. 2 but with the components in another operational position.
Figure 2:
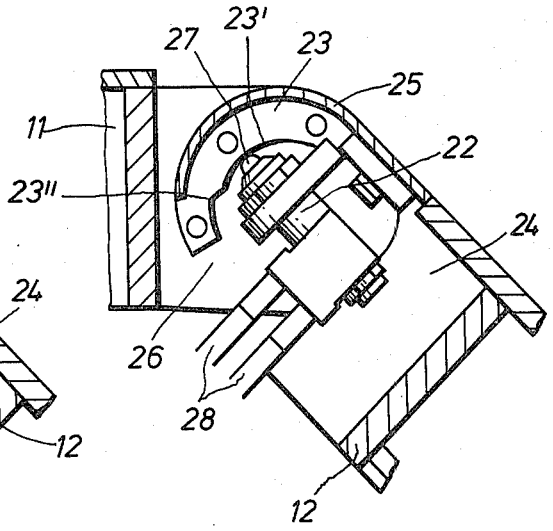
FIG. 2 is an enlarged part-sectional side view of part of the support and apparatus shown in FIG. 1 with components thereof in one operational position.

In order to prevent damage to the unit 17 and/or other component parts apparatus is provided as now described. A pilot valve device 22 is mounted to the upper end region of the goaf shield 12 and an associated operating member 23 is mounted to the rear end region of the roof structure 11. The operating member 23 is a plate of arcuate configuration having a concave cam driver surface 23' engaging with a displaceable spring-loaded plunger 27 which acts as an actuator for operating a valve in the body of the device 22. Both the goaf shield 12 and the roof structure 11 are provided with hollow portions which form chambers 24, 26 in which the device 22 and the associated member 23 are housed. A cover 25 mounted to the goaf shield 12 protects the device 22 and the member 23. The cover 25 has a curved wall portion which locates in the chamber 26 and generally matches the curvature of the member 23 to extend around the latter. The cover 25 preferably also has side wall portions (not shown) so as to virtually enclose the device 22 and the associated member 23. The device 22 and its operating member 23 are thus reliably protected from damage. It is of course quite feasible to reverse the device 22 and the member 23 so that the device 22 is mounted in the chamber 26 of the roof structure 11 and the member 23 is mounted in the chamber 24 of the shield 12. As illustrated however, the operating member 23 is conveniently detachably secured to the roof structure 11 and the centre of the cam driver surface 23' is positioned to align with the axis of the pivot connection 14. The surface 23' is stepped to provide the deepened depression 23'' smoothly merging with the remainder of the surface 23'. As the roof structure 11 and the goaf shield 12 are pivoted relative to one another by the extension or retraction of the props 13, the surface 23' of the member 23 slidably moves over the plunger 27 and the transition between the depression 23'' and the remainder of the surface 23' causes the plunger 27 to retract or extend in relation to the body of the device 22. This device 22 contains a valve which is incorporated in the hydraulic sense in a hydraulic pressure-fluid feed line 28 extending to the valve device 21 which connects to the pressure chambers of the props 13. So long as the plunger 27 contacts the surface 23' of the operating member 23 other than the depression 23'' thereof, the plunger 27 is held in the body of the device 22 and the valve thereof is maintained open to permit pressure fluid to pass freely to the props 13 under control of the device 21. However, when the relative pivot angle between the roof structure 11 and the goaf shield 12 reaches a certain pre-determined value, commensurate with the near full extension of the unit 17, the plunger 27 contacts the depression 23'' of the surface 23' of the member 23. The plunger 27 hence moves outwardly from the body of the device 22 and the valve thereof closes to isolate the props 13 and the device 21 from the pressure fluid supply. In this way the unit 17, at least, is protected. FIG. 3 depicts the roof structure 11 and the goaf shield 12 in a relative angular disposition corresponding to the chain-dotted lines 11', 12' in FIG. 1. In this position the plunger 27 is just entering the depression 23'' to cause the valve of the device 22 to close. Once this occurs the roof structure 11 and the goaf shield 12 cannot moved further by the props 13 to assume a more extreme angular disposition likely to damage the unit 17 and/or other component parts. During operation, a partial roof or stowage collapse can act, for example on the shield 12, to force the pivot connection 14 downwards tending to bring the roof structure 11 and the shield 12 more or less into alignment as depicted in FIG. 1 (chain-dotted lines 11', 12'). Although other protective measures can be adopted the device 22 will also act to block the props 13 under these conditions. FIG. 2 depicts the roof structure 11 and the goaf shield 12 in a relative angular disposition corresponding to the full line representation of FIG. 1. In this case, the plunger 27 contacts the surface 23' outside the depression 23'' and the valve of the device 22 is held open to permit the props 13 to be extended or retracted under normal control of the device 21.

The protective apparatus as described can be modified in various ways, for example, other forms of operating means including different forms of cams or stops can be utilized to operate the valve of the device 22 directly according to the relative angular disposition between the roof structure 11 and the shield 12.

We claim:

1. In a mine roof support with a roof-engageable structure, the goaf shield pivotably connected to said roof-engageable structure and hydraulic props operable to raise and lower said roof-engageable structure, a hydraulic valve device and means for operating said device to prevent operation of the props whenever the roof-engageable structure and the goaf shield reach a pre-determined relative angular disposition, the improvement comprising: the valve device and the operating means are mounted separately from said hydraulic props and directly to the roof-engageable structure and the goaf-shield in a protected position which is in the region of the axis of pivotal connection between the roof-engageable structure and the goaf-shield and which allows the valve device and the operating means to move angularly in relation to one another in correspondence with a change in the angular disposition of the roof-engageable structure and the goaf-shield.

2. A support according to claim 1, wherein a piston and cylinder unit is connected between the roof-engageable structure and the goaf shield and the valve device is operated to prevent operation of the props as the piston and cylinder unit tends towards its fully extended position.

3. A support according to claim 1, wherein the valve device has an actuating plunger engaged by the operating means and the operating means has a cam surface in slidable contact with the actuating plunger.

4. A support according to claim 1, wherein the operating means moves in a non-rectilinear manner as the angular position between the roof-engageable structure and the goaf shield changes.

5. In a mine roof support comprising a roof-engageable structure, a goaf-shield, a pivot connection pivotably connecting the goaf shield to the roof-engageble structure and hydraulic props operable to raise and lower the roof-engageable structure and the goaf shield when connected to a supply of hydraulic pressure fluid; the improvement comprising chambers within the goaf shield and the roof-engageable structure in the region of the pivotal connection therebetween, a valve device and means for operating said valve device accommodated within the chambers, the valve device and the operating means being mounted separately from the hydraulic props and directly to the roof-engageable structure of the goaf-shield, the operating means moving angularly in relation to the valve device to follow a change in the angular relationship between the roof-engageable structure and the goaf shield and serving to operate the valve device automatically to effectively block the props from the pressure fluid supply to prevent their retraction whenever the roof-engageable structure and the goaf shield assume a pre-determined angular relationship.

6. A support according to claim 2, wherein a hydraulic piston and cylinder unit is connected between the roof-engageable structure and the goaf shield and the valve device is operated to block the props as the unit becomes fully extended.

7. A support according to claim 2, wherein the valve device has an actuating plunger engaged by the operating means and the operating means has a cam surface in slidable contact with the actuating plunger.

8. A support according to claim 7, wherein the operating means is a plate with said cam surface.

9. A support according to claim 7, wherein the cam surface is arcuate and has a centre which coincides with the pivot axis of the pivot connection.

10. A support according to claim 9, wherein the cam surface has a depression which initiates the blocking of the props when contacted by the actuating member.

11. A support according to claim 2, wherein a cover screens-off and protects the valve device and the operating means.

12. A support according to claim 2, wherein the props are supported by a floor-engageable structure and levers are connected between the floor-engageable structure and the goaf shield.

13. A support according to claim 2, wherein the operating means moves in a non-rectilinear manner as the angular position between the roof-engageable structure and the goaf shield changes.

* * * * *